US005657696A

United States Patent [19]

Bishop

[11] Patent Number: 5,657,696

[45] Date of Patent: Aug. 19, 1997

[54] SWITCHES FOR AUTOMATED GUIDEWAY TRANSIT SYSTEMS

[76] Inventor: Arthur Ernest Bishop, 21 Seaman St., Greenwich NSW, Australia, 2065

[21] Appl. No.: 591,472

[22] PCT Filed: Jul. 12, 1994

[86] PCT No.: PCT/AU94/00387

§ 371 Date: Jan. 11, 1996

§ 102(e) Date: Jan. 11, 1996

[87] PCT Pub. No.: WO95/02729

PCT Pub. Date: Jan. 26, 1995

[30] Foreign Application Priority Data

Jul. 13, 1993 [AU] Australia ..... PL 9932

[51] Int. Cl.[6] ..... E01B 26/00

[52] U.S. Cl. ..... 104/130.05; 104/130.11

[58] Field of Search ..... 104/101, 130.05, 104/130.11

[56] References Cited

U.S. PATENT DOCUMENTS

| | | | |
|---|---|---|---|
| 2,903,972 | 9/1959 | Schuetze . | |
| 2,997,004 | 8/1961 | Rosenbaum et al. | 104/130.11 |
| 3,013,504 | 12/1961 | Schuetze . | |
| 3,093,090 | 6/1963 | Rosenbaum | 104/130.11 |
| 3,472,176 | 10/1969 | Trent . | |
| 3,477,389 | 11/1969 | Trent | 104/130.11 |
| 3,918,665 | 11/1975 | Alimanestianu et al. | 104/130.11 |

FOREIGN PATENT DOCUMENTS

| | | | |
|---|---|---|---|
| 66578/81 | 2/1981 | Australia . | |
| 2050409 | 12/1992 | Canada . | |
| 0151012 | 8/1985 | European Pat. Off. . | |
| 2148697 | 4/1973 | Germany | 104/130.11 |
| 2417040 | 10/1975 | Germany . | |
| 3004406 | 8/1981 | Germany . | |
| 4062201 | 2/1992 | Japan | 104/130.11 |
| 607056 | 5/1978 | U.S.S.R. | 104/130.05 |
| 1404648 | 9/1975 | United Kingdom | 104/130.05 |
| 94/18048 | 8/1994 | WIPO . | |
| 94/23980 | 10/1994 | WIPO . | |

OTHER PUBLICATIONS

JP,A,3–31055 (Hitachi), Feb. 8, 1991, Journal 119–M–1105.
SU,A,1486–544 (Grebennikov), Jun. 15, 1989, Derwent Abstract 90–097763/13.

*Primary Examiner*—S. Joseph Morano
*Attorney, Agent, or Firm*—Spencer & Frank

[57] ABSTRACT

A combination includes railway tracks, each having two substantially parallel rails, each of the rails having a substantially horizontal ledge. The tracks include a first track defining a transverse discontinuity along a length thereof and comprising a first track segment and a second track segment, each of the track segments including rail ends defining a corresponding edge of the discontinuity. A second branch track diverges laterally from the first track and includes rail ends adjacent one side of the discontinuity. The first track segment further includes a switch zone portion which can flex between a first position where the rail ends of the first track segment align with the rail ends of the second track segment, and a second position where the rail ends of the first track segments align with the rail ends of the second branch track. Ties connect the rails of the switch zone portion to one another and maintain these rails in a substantially constant spaced relationship.

14 Claims, 11 Drawing Sheets

SWITCHES FOR AUTOMATED GUIDEWAY TRANSIT SYSTEMS

FIELD OF THE INVENTION

This invention relates to switches for rail/guideway systems, and in particular relates to a switch suitable for use with Automated Guideway Transit (AGT) systems of the type using small, individual vehicles, capable of operating at high speeds, with a spacing between vehicles of only three or four seconds, the vehicles running on a pair of spaced apart rails. However, the switch of the invention is suitable for use with a variety of other rail/guideway systems.

BACKGROUND OF THE INVENTION

In AGT systems of the type mentioned above, it is a requirement that vehicles be capable of frequent stopping at stations located off the main line in order that a high mean track speed on the main line is achieved, notwithstanding that such stations may be spaced at close intervals.

It must be possible for alternate vehicles to follow either the mainline or turn off to a branch line, with a minimal loss of speed. As such, the switch length must be short and the switch actuation time minimal, for example, two seconds or less. Preferably any turning section which is used to branch from a main line should be banked for passenger comfort.

Conventional railway switches are not used for AGT systems for several reasons. First, AGT systems often use elevated guideways to avoid interference with ground-level traffic, and are too obtrusive in city or suburban environments unless the track is narrow, typically about one half the width of the vehicle, and are often termed monorail systems. In such systems, provision must be made by way of extra wheels and guide surfaces to prevent vehicles from overturning, for example, in high winds. Such extra guide surfaces are usually provided at a level underneath a flat, broad load carrying track so further complicating the design of switches and precluding the use of conventional railway switches.

Second, it is not practical to bank the turning rails in conventional railway switches.

Third, in AGT systems it is typical for power to be supplied from the guideway, for example, by longitudinal conductors as in the case of some conventional electric railways which use a third rail for this purpose; as overhead conductor wires are generally unsuited to elevated guideways on aesthetic grounds. In the case of AGTs, additional longitudinal conductors are also typically required to provide control and communication channels. Such groups of longitudinal conductors cannot intersect the running surfaces, and hence in conventional railway switches, both the conductors and the collecting brushes on the vehicle are duplicated on each side of the vehicle and track in order to provide a continuous electrical connection in the switch zone.

Some prior art proposals have attempted to overcome the problems associated with switching of monorail and other guideway systems by laterally shifting a first section of the guideway together with the longitudinal conductors and supplemental guiding surfaces, and moving into its place a second section, the first section of guideway being straight and flat and the second section curved and banked. However, the problem with such prior art proposals is that the switching time is long because of the need to move massive structures. Other prior art proposals have included the bending of an entire monorail structure including the switching zone, these proposals being generally related to fast trains where switching time is not important.

One impractical prior art proposal is that by Trent in U.S. Pat. Nos. 3,472,176 and 3,477,389, which show a narrow beam carrying a track surface which is bent and twisted by virtue of being supported by a series of vertical supports or posts. These posts are inclinable, being hinged at a point well below the surface of the ground, and arranged to provide for banking as well as bending of the track in the switch zone. The impracticality of such a proposal is that, first the switching structure may well extend for hundreds of meters, and with the beam dimensions disclosed could weigh many hundreds of tons. Second, it is not acceptable to relate the amount of side shift to the roll angle (or incline) which inevitably occurs within this arrangement. For example, the last pivoted support would extend about 23 meters into the ground if the recommended bank angle of fifteen degrees continued to that point. Additionally, as it is well known in the flexing behaviour of beams, the curvature decreases to zero for lateral loads applied at the end of a beam, so that the appropriate incline angle would also be zero, which Trents' structure could not provide.

Another impractical proposal is by J. Rosenbaum et. al. in U.S. Pat. Nos. 2,997,004 and 3,093,090, which disclose the use of a box type beam of narrow width (which is straddled by the railway carriages to provide stability) and which is bent sideways to provide side-shifting of the track to effect switching. However, as in the case of the earlier mentioned Trent proposal, this arrangement involves the moving laterally of the entire beam structure from one position to the other, which would be quite difficult. Neither Rosenbaum or Trent make provision for flexing the beam structure in twist which is desirable to provide banking.

Similarly G. Schutze in U.S. Pat. Nos. 3,013,504 and 2,903,972 shows a box type guideway having the same limitations as noted above.

The prior art switching proposals are not suited for use in AGT systems where individual vehicles travel in a stream at high speeds and at relatively close spacing from one another, and it is therefore an advantage if the vehicles are able to detour or switch from the main line or track when stopping at stations to allow through vehicles to pass without slowing down. Any switch in such an arrangement must be able to move from the main line to the branch line rapidly, and the switch length should preferably be short as mentioned earlier. This would result in passengers experiencing high lateral accelerations when the vehicle is traversing the curved track in the branch line position which would be more acceptable to passengers if the track is appropriately banked when in the branch position. If the track is narrow, and hence the required displacement is less, the degree of side acceleration is also less. Such a narrow track is described in co-pending International application PCT/AU94/00046 corresponding to co-pending U.S. patent application Ser. No. 08/500,862 entitled Self Steering Railway Bogie in which the guideway may be elevated and the vehicle is locked onto the track, for example by grip wheels as described in further co-pending international application PCT/AU94/00201 corresponding to co-pending U.S. patent application Ser. No. 08/537,792 entitled Rail Gripping Vehicle. Such a narrow track arrangement, in which grip wheels run on the underside of the rail head precludes the use of existing railway switching techniques and would make rail crossover areas impractical which is recognised in the earlier mentioned art of Rosenbaum, Trent and Schutze.

SUMMARY OF THE APPLICATION

The fundamental purpose of this invention is to provide a switch for the track of a guideway or railway which overcomes or improves on the disadvantages associated with the abovementioned prior art.

In a broad aspect the present invention, a combination includes railway tracks, each having two substantially parallel rails, each of the rails having a substantially horizontal ledge. The ledge has an upper running face and a lower running face juxtaposed on opposite sides thereof, respectively. The railway tracks further include a first railway track defining a transverse discontinuity along a length thereof and comprising a first track segment and a second track segment, each of the track segments including rail ends defining a corresponding edge of the discontinuity. A second branch railway track diverges laterally away from the first railway track and includes rail ends adjacent one side of the discontinuity. The first track segment further includes a switch zone portion which can flex between a first position where the rail ends of the first track segment align with the rail ends of the second track segment, and a second position where the rail ends of the first track segments align with the rail ends of the second branch railway track. Ties connect the rails of the switch zone portion to one another and maintain these rails in a substantially constant spaced relationship. The combination further includes a switch mechanism connected to at least one of the ties for moving the switch zone portion between its first position and its second position such that a distance travelled by the rail ends of the first track segment in moving between the first position and the second position exceeds a spacing between rail ends of the first railway track.

Preferably the rails are arranged for limited pivotal movement with respect to the ties of the first track segment during operation of the means for transporting.

Preferably the means for transporting elevates and lowers the rail ends of the first track segment as it moves them between the first and second positions.

Preferably each of the first and second railway tracks are supported by a structure having abutments, the ties being supported and located by the respective abutments when seated in either the first or second positions.

Preferably, the means for transporting is constructed and arranged to incline one or more ties in the switching zone during movement of the rail ends of the first track segment from the first to the second position to cause at least one part of said track in said switching zone to be cambered in a manner that increases smoothly in order to impart a smooth rolling motion to the vehicle traversing that part of the switch zone.

Preferably the means for transporting is a switching mechanism having a linkage of substantially parallelogram configuration with arms which pivotally interconnect the ties with a support structure.

In a preferred form, the present invention can be used with the track and dihedral wheel and grip wheel configuration as disclosed in the earlier mentioned co-pending U.S. patent application Ser. Nos. 08/500,862 and 08/537,792, which provides, in addition to other advantages described therein, a track assembly capable of being flexed from a first position where, for example, it may be a straight extension of the main track to the second position where it assumes a banked and curved configuration to align with a branch track.

In another form, the switch of the present invention may take a form similar to that of a conventional railway comprising two substantially parallel rails whose spacing is determined by ties, except that some of the ties may be swivellably or resiliently connected to the rails to provide for slight angular rotation there-between in some areas of the switch zone. The ties may be supported on pivots or linkages beneath the track which are displaceable between two positions, one corresponding to the main track and the other to the branch track. The linkages are such that in the main track setting, the rails of the switch zone are straight and flat, and their ends precisely align with those of the main track, whereas in the branch track setting, the rails of the switch zone are smoothly and appropriately banked or cambered and their ends precisely align with those of the ongoing branch track. In such an embodiment it would be preferable to have the ties supported by appropriate abutments provided on the foundations, beams or girders which support the switch.

BRIEF DESCRIPTION OF THE DRAWINGS

The invention will now be described by non-limiting examples with reference to the following drawings.

DETAILED DESCRIPTION OF THE INVENTION

Figure 1:
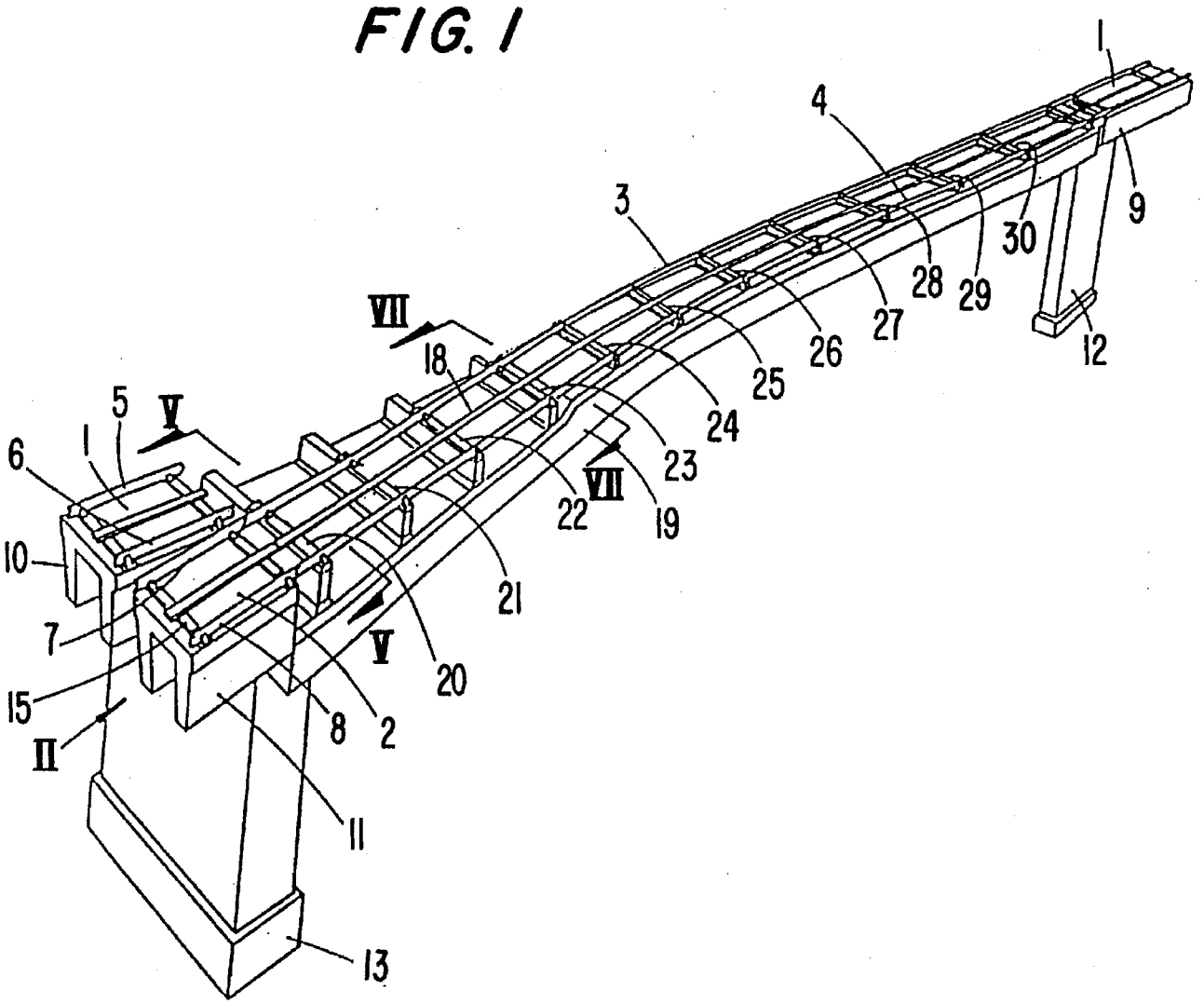
FIG. 1 is a perspective view of a branched railway track to which a switch according to the invention is applied.

FIG. 1 shows the switch according to one embodiment of the invention in which the rails of railway track 1—1 can be switched to align with rails of branch railway track 2 and back again by flexing rail portions 3 and 4 which constitute a switch zone to align alternatively with the rail ends of rails 5 and 6 of railway track 1—1 or the rail ends of rails 7 and 8 of branch railway track 2. It is here shown in the branch track setting of the switch where rail portions 3 and 4 are aligned with rails 7 and 8. Track 1—1 defines a transverse discontinuity along the length thereof.

Figure 2:
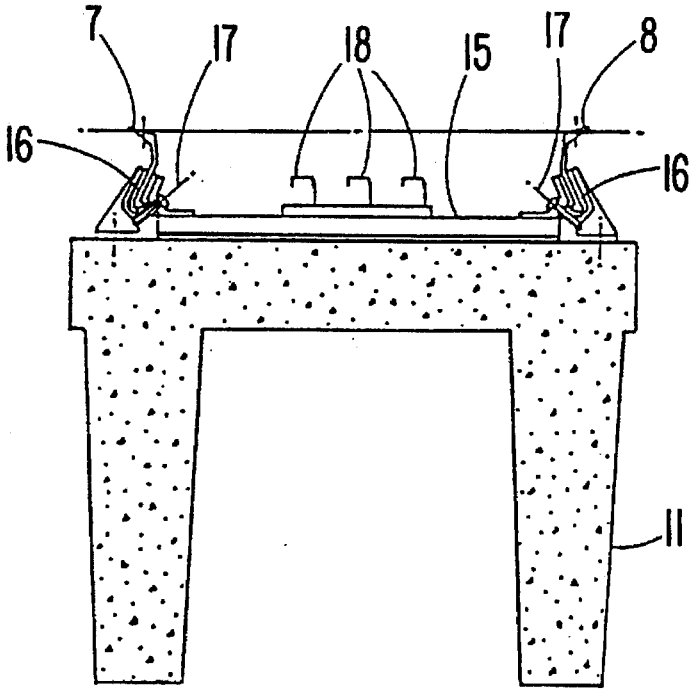
FIG. 2 is a view of the branched railway track of FIG. 1 in the direction of arrow II (supporting beam)
Figure 3:
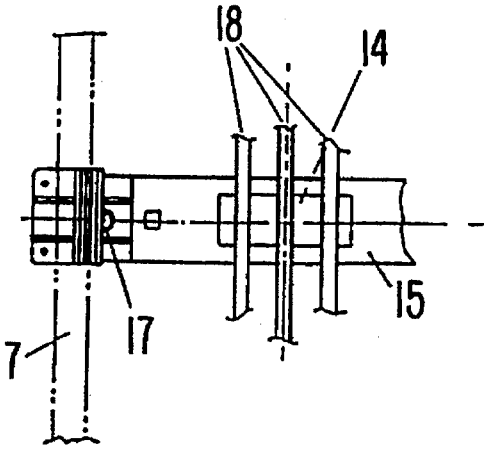
FIG. 3 is a top plan view of a portion of the track and conductor of FIG. 2.
Figure 4:
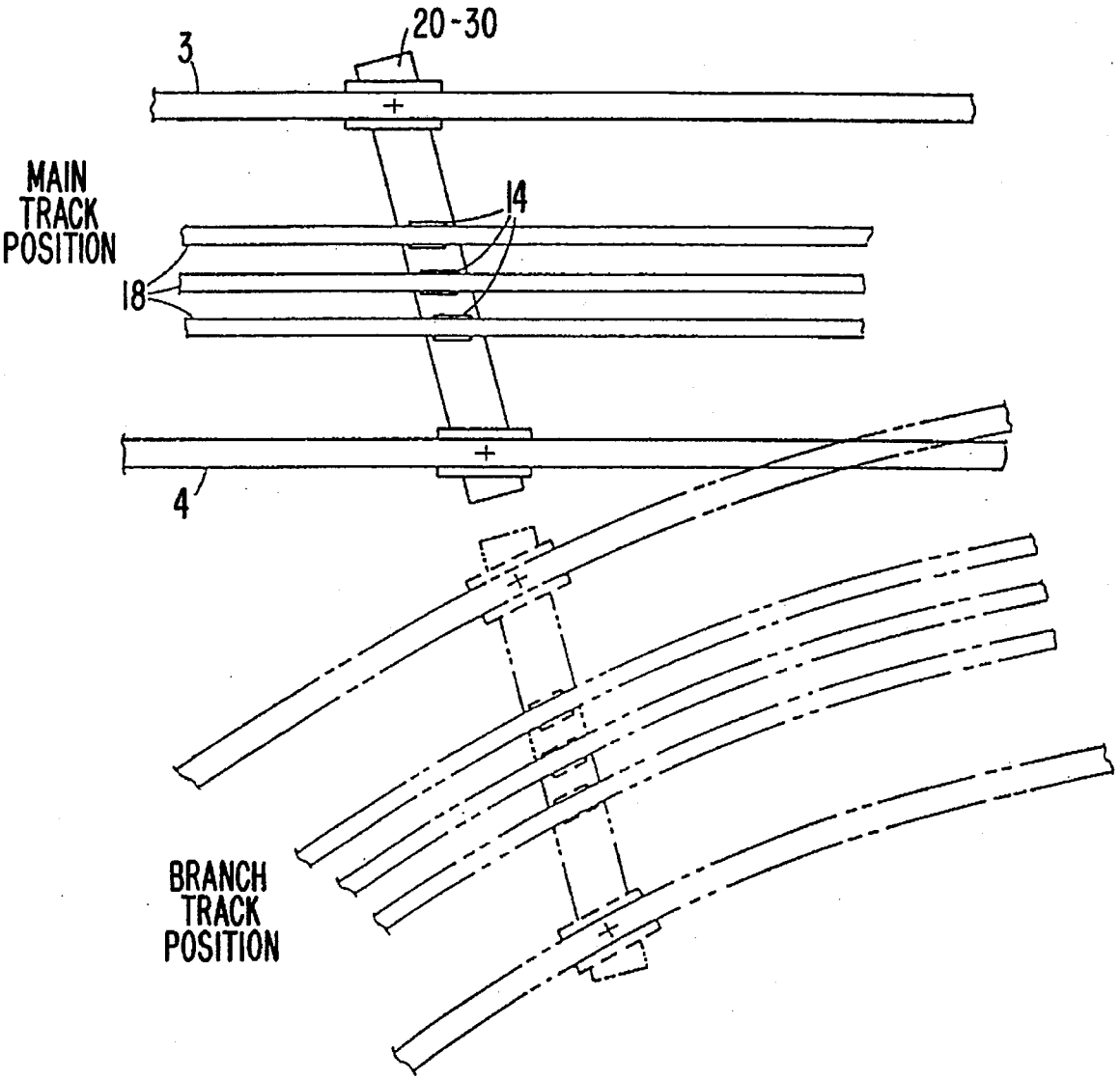
FIG. 4 is a schematic top plan view of the flexing portion of the rails which form part of the track and switch of FIG. 1.

Tracks 1—1 and 2 are supported on beams 9, 10 and 11, which rest on columns 12 and 13. The beams 9, 10 and 11 support the respective rails on ties 15 spaced along the track at regular intervals outside the switch zone. Beams 9,10 and 11 are preferably made of reinforced concrete, see FIGS. 2 and 3. As seen in FIGS. 2, 3 and 4 rails 7 and 8 are secured to ties 15 via noise isolating pads 16 by bolts 17. Ties 15 also support conductors 18 suitably insulated by insulators 14.

Columns 12 and 13 also support beam 19 which serves to support the track throughout the switch zone. Here the normal ties as at 15 are replaced by ties of differing types along the length of the switch zone numbered 20 to 30 (FIG. 1) to which rail portions 3 and 4 are swivellably and/or resiliently secured as shown greatly exaggerated in FIGS. 4 & 5 in a manner which allows slight swivelling to occur. Conductors 18 and insulators 14 are also similarly configured to swivel.

Figure 5:
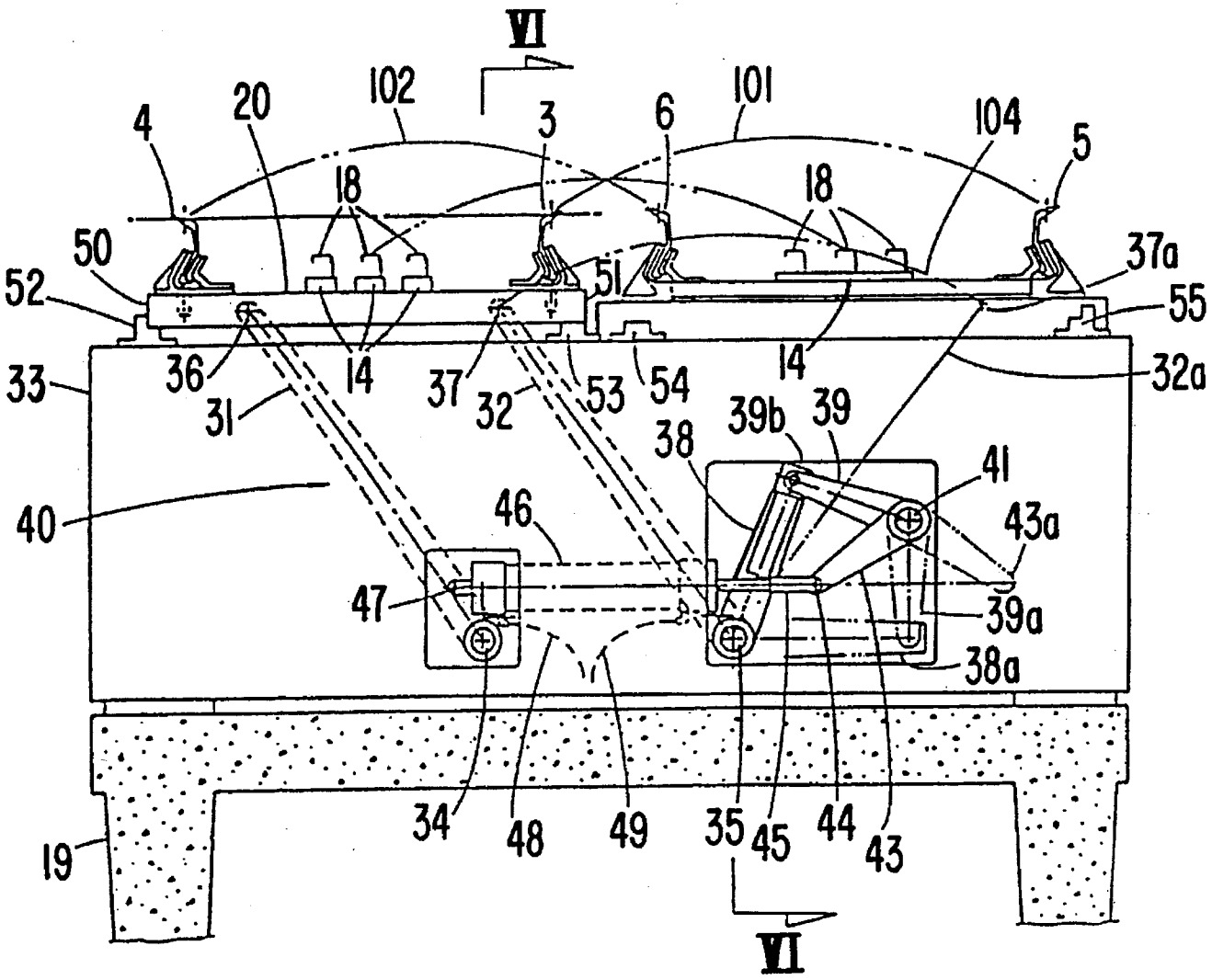
FIG. 5 is a cross-sectional view along line V—V of FIG. 1.
Figure 6:
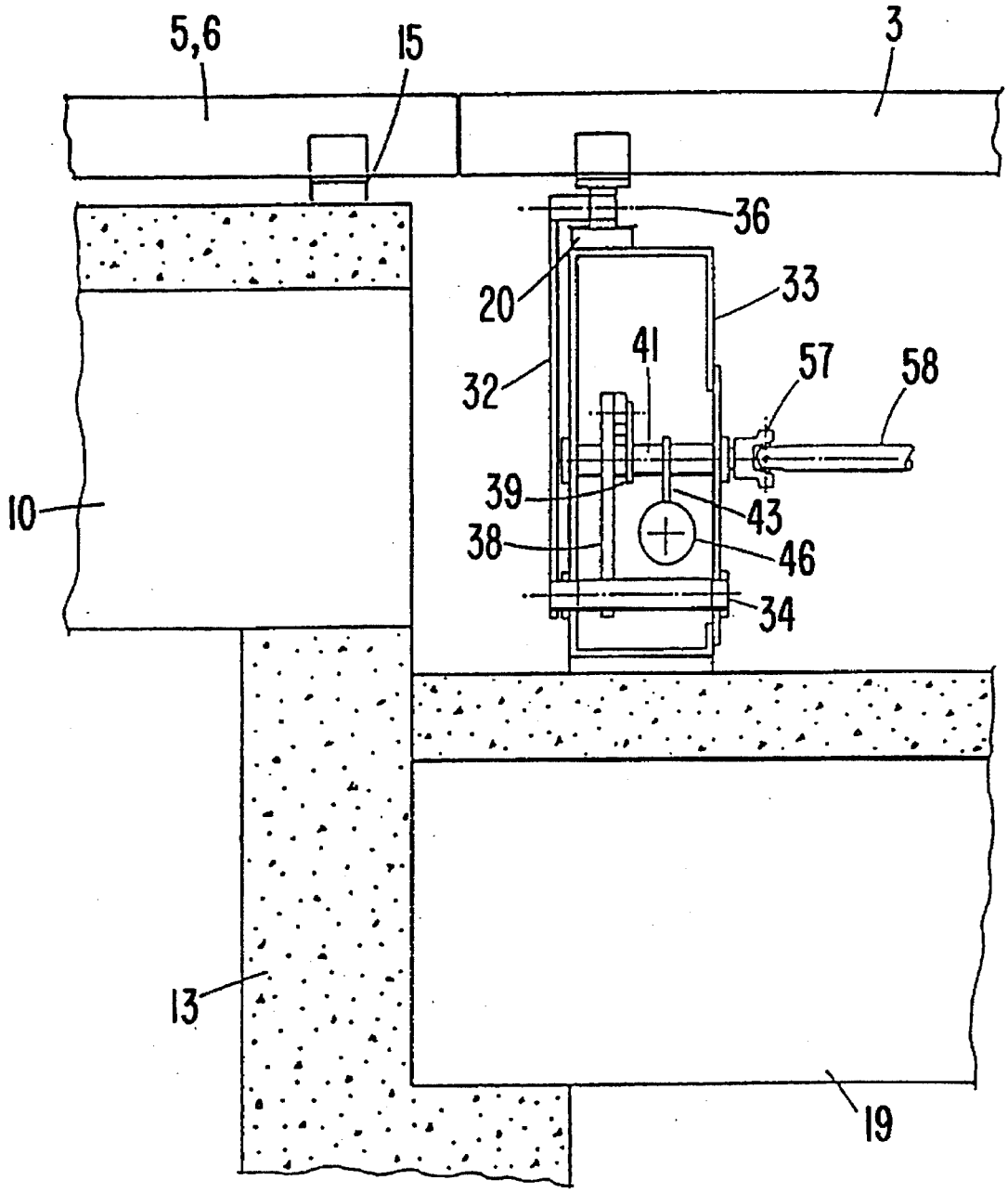
FIG. 6 is a cross-sectional view along line VI—VI of FIG. 5.

The switching mechanism 40 for transporting or moving the tie 20 is shown in FIGS. 5 and 6 in the branch track setting. Switching mechanism 40 comprises a parallelogram linkage of two levers 31 and 32 which support tie 20 and are secured to shafts 34 and 35 respectively, which extend outside casing 33 for that purpose. At their upper ends, levers 31 and 32 are fitted with pins 36 and 37 which are journalled in tie 20 or alternatively mounted in rubber bushes (not shown).

Shaft 35 has attached to it within casing 33, lever 38, having a radially extending slideway in which operates matching slide block 39*b*, the latter being pivotally connected to actuating arm 39. Actuating arm 39 is secured to shaft 41 also journalled in casing 33.

Arm 43 is also secured to shaft 41 and its outer end is pivoted at pivot point 44 to clevis 45 of hydraulic cylinder 46. Cylinder 46 is pivoted to casing 33 as at pivot point 47 and is connected by hydraulic lines 48 and 49 to an appropriate source of hydraulic power and actuating means (not shown).

Upon oil being admitted to line 48 and hence to cylinder 46, the clevis 45 moves arm 43 to the position indicated (chain dotted) as at position 43*a*, causing actuating arm 39 to move to position 39*a* and lever 38 to position 38*a*. It is to be noted that actuating arm 39 and lever 38 are at right angles to each other at both extremes of travel of cylinder 46 so that, for example, in the position shown in FIG. 5, levers 31 and 32 are secured in the position shown. In this position, tie 20 is not only secured as described but also is fixed against any movement by having its left and right extremities 50 and 51 seated in location blocks (or abutments) 52 and 53 attached to casing 33. It will be seen that upon operation of cylinder 46 as just described lever 32 rotates to the dotted position as at 32*a* and pin 37 moves to position indicated as at 37*a* along the chain dotted line 104. Tie 20 (not shown at position 37*a*) will therefore be raised and transported to a position where the rail ends of rail portions 3 and 4 move to a position aligned with those of rails 5 and 6 corresponding to a main track setting of the switch where the track of the switch zone is aligned with track 1—1. The upper face of rail 3 will move along the chain dotted line 101. In this position tie 20 will have its extremities 50 and 51 seated on location blocks 54 and 55 also attached to casing 33. Note that the ends of conductors 18 in the branch track position (FIG. 5) will also be raised and transported clear of rail 6.

In FIG. 6 it will be seen that rails 5 and 6 project from the end of beam 10, being last supported on tie 15. Tie 15 also supports longitudinal conductors 18 in the same manner as for all ties within the nonswitching zone of tracks 1—1 & 2 (not shown in FIG. 6).

Figure 7:
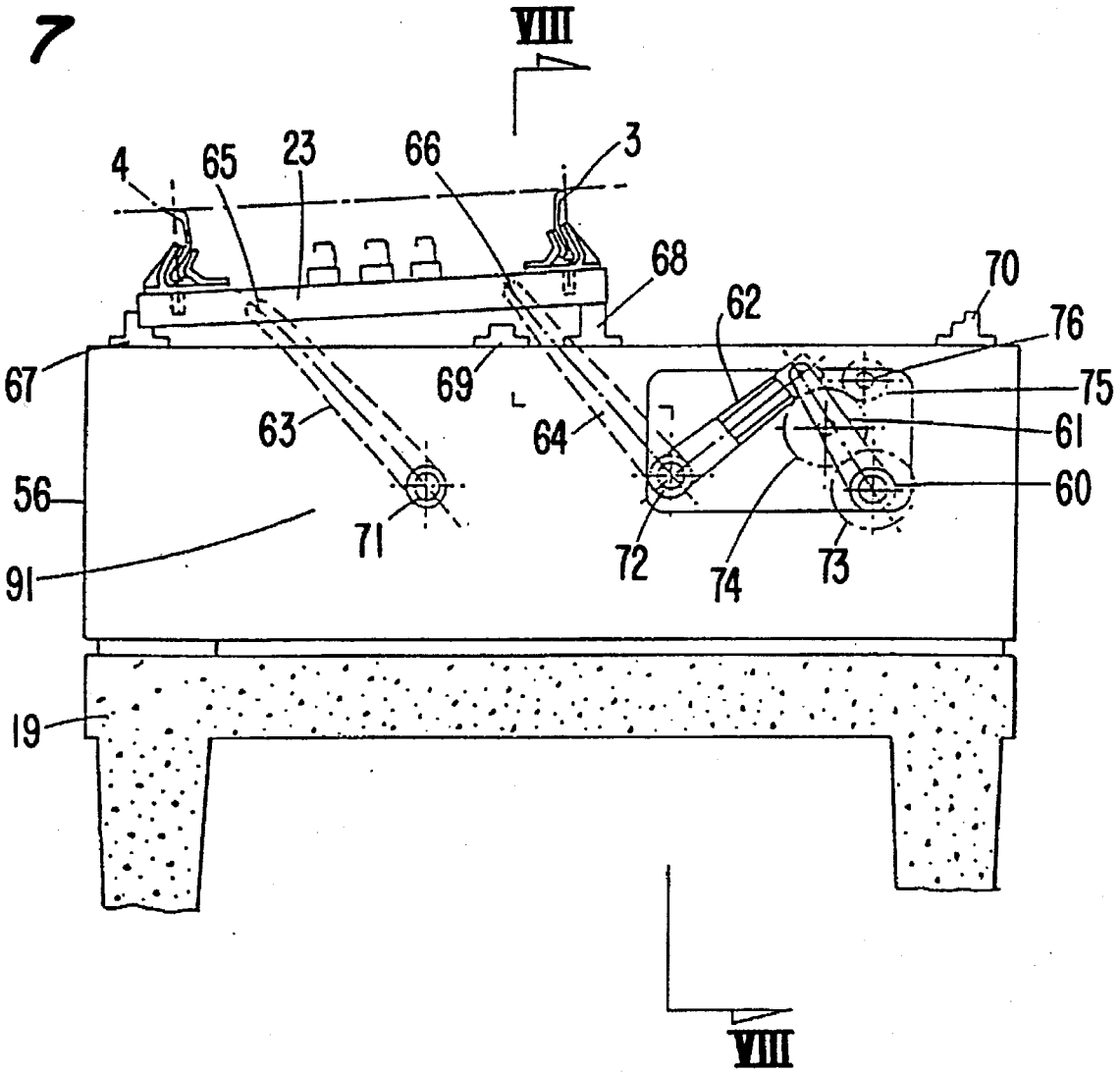
FIG. 7 is a cross-sectional view along line VII—VII of FIG. 1.
Figure 8:
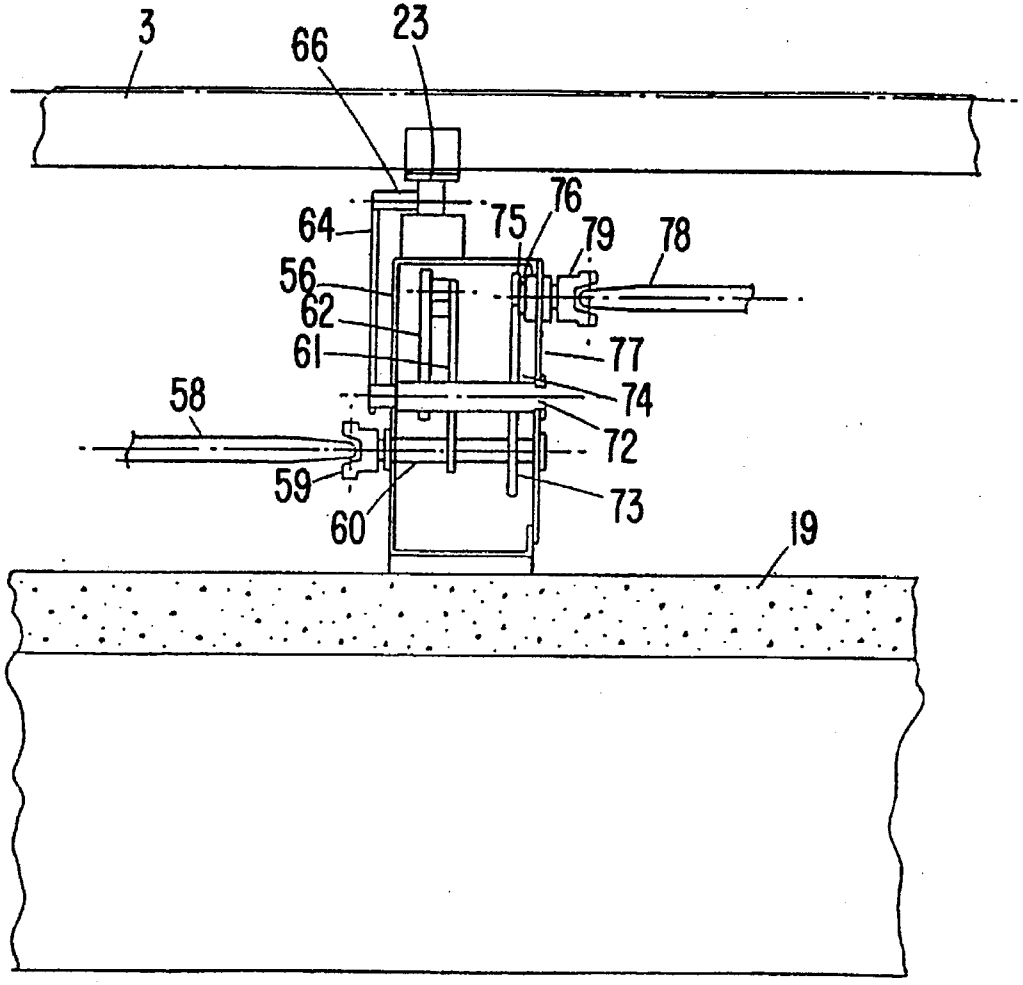
FIG. 8 is a sectional view on line VIII—VIII of FIG. 7

With reference to FIGS. 6, 7 and 8 it will be seen that shaft 41 extends outside casing 33 to mount universal joint 57, which is also attached to the end of shaft 58 which extends along beam 19 to tie 23 where it drives a switching mechanism 91 similar to the switching mechanism 40 that supports tie 20, but on a smaller scale as appropriate to the lesser shift of rail portions 3 and 4 required at that point. Because the movement of rail portions 3 and 4 is closely controlled at ties 20 and 23, it is sufficient at ties 21 and 22 to provide location blocks similar to 52, 53, 54, and 55, mounted on respective casings at these places. As shown in FIG. 8, shaft 58 connects to shaft 60 via universal joint 59, which rotates lever 61 through the same angle as arm 39 (of FIG. 5).

Thus lever 61 corresponds to arm 39 (of FIG. 5) and likewise levers 62, 63 and 64 (FIG. 7) correspond to levers 38, 31 and 32 respectively of FIG. 5. Likewise location blocks 67, 68, 69 and 70 and pins 65 and 66 of FIG. 7 correspond to location blocks 52, 53, 54 and 55 and pins 36 and 37 of FIG. 5 respectively. Shafts 71 and 72 are so positioned that tie 23 is inclined to the left (as seen in FIG. 7) in the branch track. This inclination is to lessen the centrifugal force apparent to passengers within a vehicle travelling on the track, as it passes through the switch zone onto the branch track 2. Shaft 60 carries gear 73, which drives through idler 74, to pinion 75 mounted on shaft 76 journalled in cover 77, so the above arrangement thus rotating shaft 78 via universal joint 79. The switching mechanism 91 is housed in casing 56. Shaft 78 extends along the beam 19 supported in bearings adjacent to each tie extending from tie 24 though to tie 30.

Figure 9:
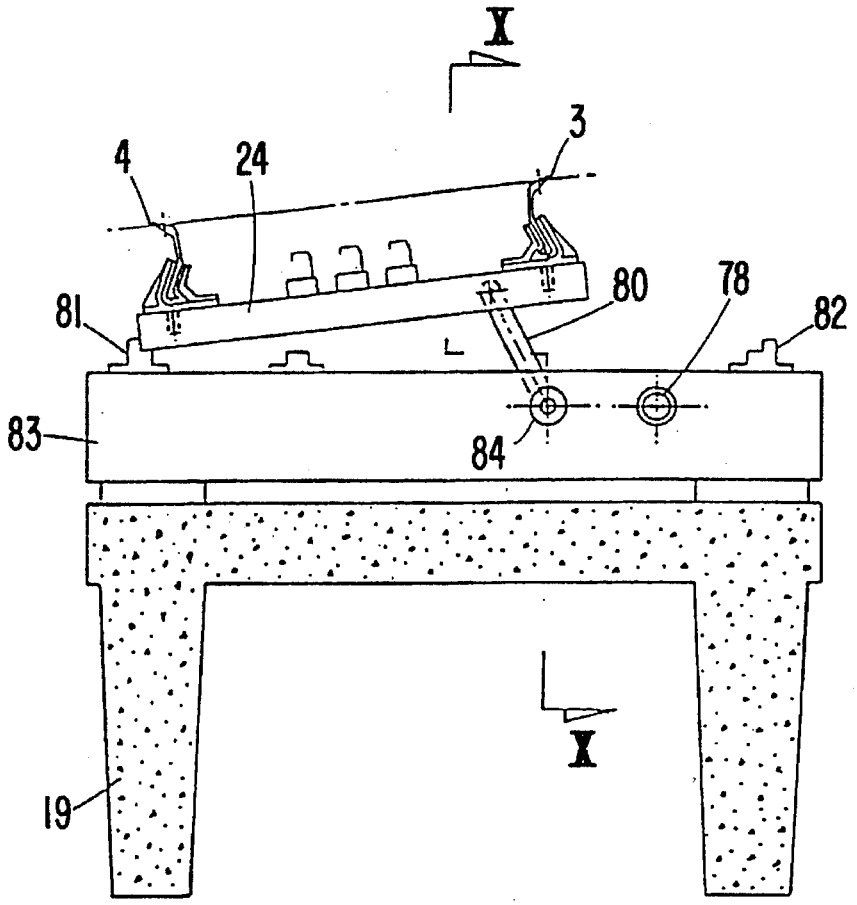
FIG. 9 is a cross-sectional view through the track and beam at tie 24.
Figure 10:
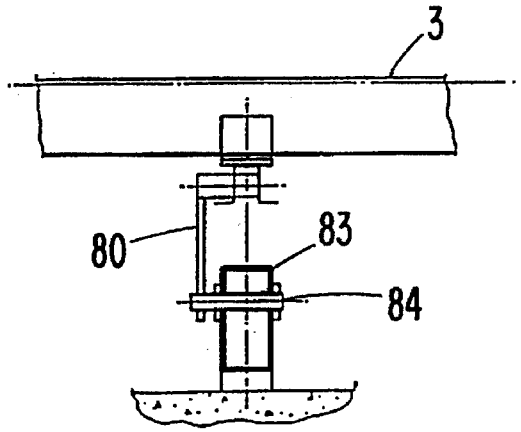
FIG. 10 is a cross-sectional view along line F—F of FIG. 9.

In the case of tie 24 (FIGS. 9 and 10) space is not available to provide a location block, corresponding to 68 of FIG. 7, but because this tie is adjacent to a further switch mechanism 92 of tie 25 (FIG. 11) it is only necessary to support tie 24 by a pivotal link 80. Location block 81 is provided to support the left-hand end of tie 24 in the branch track position and location block 82 in the main track position of the switch. Link 80 is pivoted in pedestal 83 as at location 84, and shaft 78 passes through pedestal 83 and does not contribute to the motion of tie 24. Note that the inclined angle (or roll angle) has reached its maximum angle at this point along the flexing rail portions 3 and 4.

Figure 11:
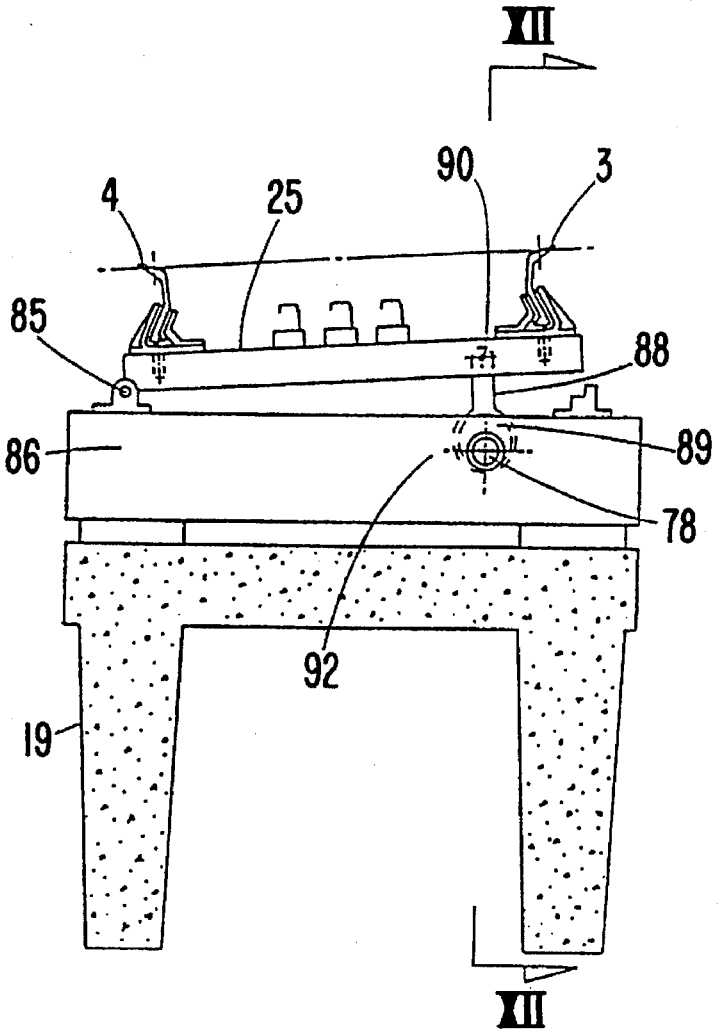
FIG. 11 is a cross-sectional view through the tracks and beam typical of ties 25 to 30.
Figure 12:
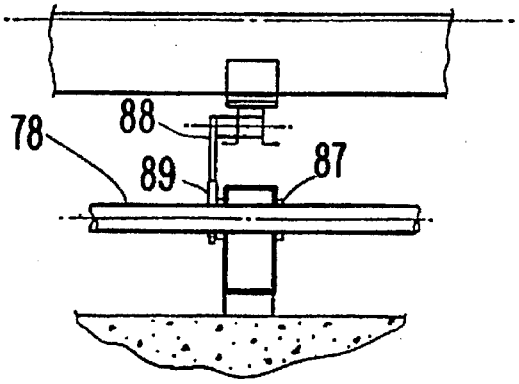
FIG. 12 is a cross-sectional view along line XII—XII of FIG. 11.

FIGS. 11 and 12 show typically the mechanism 92 for controlling the motion of ties 25 to 30. In each of these cases the tie is pivoted as at 85 to a pedestal 86 secured to beam 19. Shaft 78 is journalled in pedestal 86 as at 87 and supported by a connecting rod 88 journalled to eccentric member 89 mounted on shaft 78. The small end of connecting rod 88 is journalled as at 90 to the tie.

The degree of eccentricity of each eccentric member is progressively less between tie 25 and tie 30 so that, when a vehicle enters the switch zone of the guideway as at tie 30, a smooth rolling motion is imparted without actual side shifting at the level of the rails. Passengers in the vehicle will experience a side-shift acceleration derived from the roll acceleration. By this means, only switch mechanisms 40 and 91 are required to control both the roll and side-shift of the rails at ties 20 and 23 respectively, notwithstanding which a smoothly accelerated motion is provided of a degree made more acceptable to the passengers due to the roll motion imparted to the vehicle.

Figure 13:
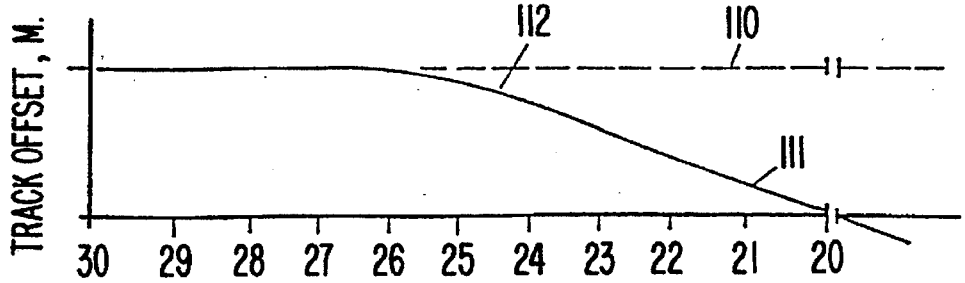
FIG. 13 is a graph showing track offset against the position of the ties.

FIG. 13 shows a plot of the centreline of the track in both the main track setting 110, and the increasing offset of the track in the branch track setting 111. The distance along the track is shown by the tie numbers commencing at tie 30 and finishing at tie 20. Between ties 30 and 27 and between ties 23 and 20 the track is approximately straight, and is curved at a constant radius 112 between ties 27 and 23.

Figure 15:
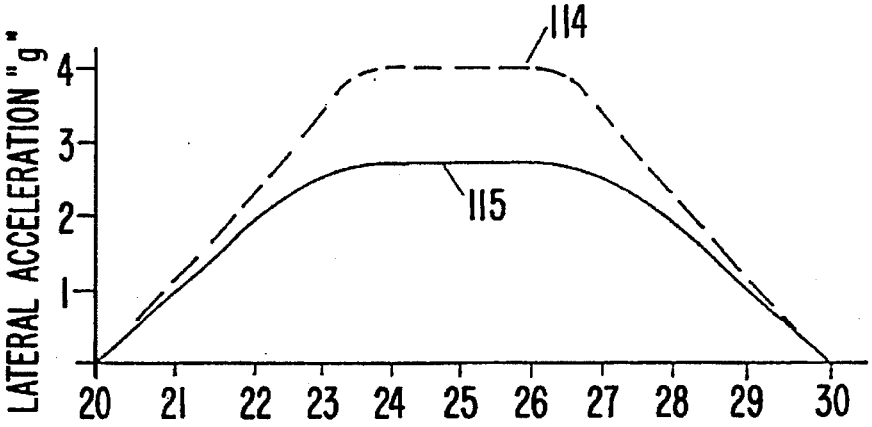
FIG. 15 is a graph showing lateral acceleration against the position of the ties.
Figure 14:
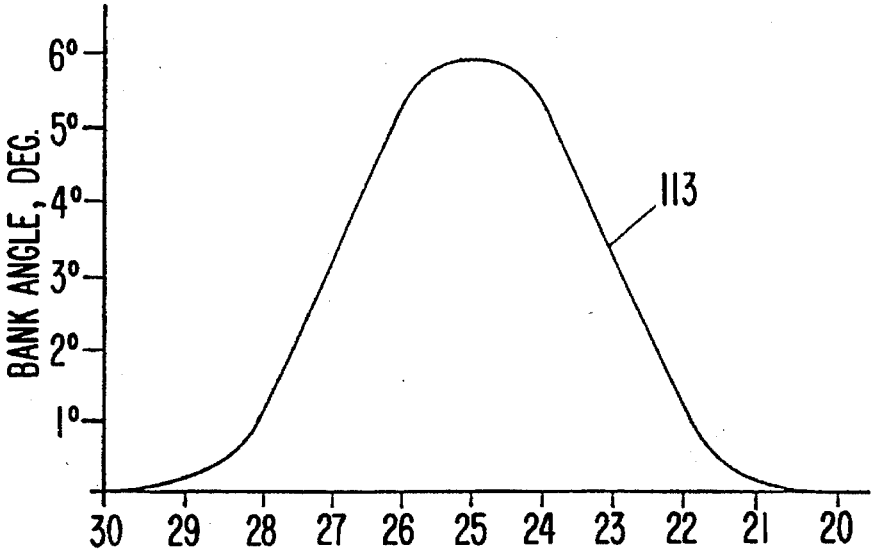
FIG. 14 is a graph showing the bank angle of the track against the position of the ties.

Referring to FIG. 14, the track is banked (line 113), smoothly increasing from tie 30 to tie 25 to a maximum value of about 6°, and then smoothly decreasing to tie 20. Because the passengers are positioned well above the track, this banking will modify the sensation of lateral acceleration resulting from the changing offsets along the track (FIG. 13), to produce a net lateral acceleration as at line 115 of FIG. 15. The vehicle wheels engaged in the track, will, however, be subject to a higher value of lateral acceleration by the line 114. This means the perceived lateral acceleration experienced by the passenger is somewhat reduced.

However, the main purpose of this acceleration pattern is to provide a smooth acceleration profile during switches with least elaboration as referred to above. Notwithstanding the apparent asymmetry of the switch appearance, shown in FIG. 1, it will be appreciated that the acceleration pattern may be made precisely the same whether the vehicle is proceeding either from the right to the left or vice versa, and that the perceived acceleration is symmetrical in regard to its increase and decrease. On the other hand, if the switch is located in a section of the track approaching a station, a different asymmetric acceleration pattern may be provided and adjusted to suit the condition where the vehicle is either slowing down in the switch zone or accelerating.

Figure 16:
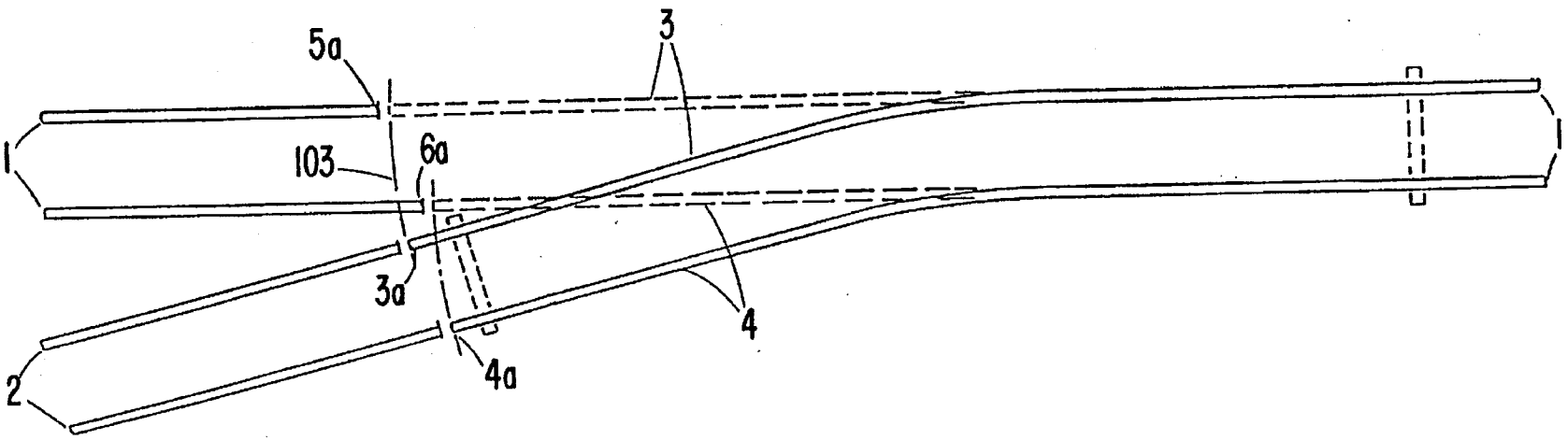
FIG. 16 illustrates diagrammatically the motion of the ends of rails 3 and 4 during switching in a top plan view.

Referring now to FIG. 16, the problem associated with the loci of movement of the rail ends during switching is illustrated. The problem occurs when rails 3 & 4 are flexed from the branch track position 2 to the main track position 1 and vice versa. Rail end 3*a* moves along the line 103 to a position adjacent to rail end 5*a*. In doing so it interferes with rail end 6*a* unless the latter is shortened. However, such shortening would result in a gap between 4*a* and 6*a* in the main track setting of the switch which is undesirable. This gap is a problem to vehicles with small diameter wheels. However, depending on the extent of the gap, it may not be significant on vehicles with larger diameter wheels.

Typically, with AGT systems where wheels are much smaller than conventional railway system wheels, this gap problem is critical.

This problem is overcome in a switch made according to the embodiment shown of the present invention because rail ends 3*a* and 4*a* follow the paths indicated as 101 and 102 respectively in FIG. 5.

The above embodiment of a switch is suited for use with AGT systems utilising a grip wheel arrangement where the grip wheels run on the underside of the rail heads.

The above embodiment has been described with reference to a main track which is straight and a branch track diverging laterally therefrom. However, the switch of the present invention could for instance be utilised in a further not shown embodiment, as on a curved main track which has a track branching therefrom.

Also in a further not shown embodiment the switch of the present invention which incorporates a flexing track section and movable ties could equally be applied to a track which divides into a Y configuration, where a single track branches into two separate tracks.

It will be appreciated by persons skilled in the art that numerous variations and/or modifications to the invention as shown in the specific embodiments without departing from the spirit or scope of the invention as broadly described. The present embodiments are, therefore, to be considered in all respects as illustrative and not restrictive.

I claim:

1. A combination including a first railway track and a second branch railway track disposed adjacent the first railway track, each of the tracks comprising two substantially parallel rails each having an upper running face juxtaposed on opposite sides of a substantially horizontally extending ledge, on which vehicles using the track run, said first railway track having a transverse discontinuity dividing it into a first track segment and a second track segment each of which have rail ends at said discontinuity, said second branch railway track diverging laterally away from said first railway track and having rail ends to one side of said discontinuity, wherein said first track segment has a portion constituting a switch zone which is arranged to flex so that the rail ends of the first track segment align in a first position with the rail ends of said second track segment and in a second position with the rail ends of said second branch railway track, the rails of said first track segment being connected and maintained in substantially constant spaced relationship by a plurality of transverse ties arranged at intervals along the switch zone, the combination further including a means for transporting connected to one or more of said ties to transport said rail ends of said first track segment laterally between said first and second positions, the distance moved by the rail ends of said first track segment in moving from one said position to the other exceeds the spacing between the rail ends of the first track segment.

2. The combination as claimed in claim 1 wherein during transport of said first track segment between said first and second positions said means for transporting initially elevates and subsequently lowers said rail ends of said first track segment.

3. The combination as claimed in claim 1, wherein said first railway track segment is supported by a structure having abutments to support and locate at least some of said ties when said rail ends of said first track segment are in either said first position or said second position.

4. The combination as claimed in claim 1 wherein the means for transporting is constructed and arranged to incline said ties in the switch zone at least one of before and during movement of the rail ends of the first track segment from the first to the second position to cause at least one part of said track in said switch zone to be cambered in a manner that increases smoothly in order to impart a smooth rolling motion to a vehicle traversing the at least one part of the switch zone.

5. The combination as claimed in claim 1 wherein said means for transporting has a linkage of substantially parallelogram configuration having arms pivotally interconnecting said ties and a support member.

6. A switch as claimed in claim 2, wherein said ties of said first track segment are each supported by a structure including an abutment to support and locate said ties when said rail ends of said first track segment are in either said first position or said second position.

7. A combination comprising:

a plurality of railway tracks, each of the tracks comprising a first rail and a second rail substantially parallel to one another, each of the rails having a substantially horizontally extending ledge including running faces comprising an upper running face and a lower running face juxtaposed on opposite sides of the ledge, respectively, the rails being configured to receive vehicles adapted to run thereon, the railway tracks further including:

a first railway track defining a transverse discontinuity along a length thereof and thereby comprising two track segments including a first track segment and a second track segment separated from one another by the transverse discontinuity, each of the track segments further including rail ends defining a corresponding edge of the transverse discontinuity; and a second branch railway track diverging laterally away from the first railway track and further including rail ends adjacent one side of the transverse discontinuity;

wherein the first track segment further includes:

a switch zone portion adapted to flex between a first position in which the rail ends of the first track segment align with the rail ends of the second track segment, and a second position in which the rail ends of the first track segments align with the rail ends of the second branch railway track; and a plurality of ties disposed at intervals along the switch zone portion and transversely with respect to the rails thereof, the ties connecting the rails of the switch zone portion to one another and maintaining the rails of the switch zone portion in a substantially constant spaced relationship with respect to one another; and a switch mechanism connected to at least one of the ties for moving the switch zone portion of the first track segment between its first position and its second position such that a distance travelled by the rail ends of the first track segment in moving between the first position and the second position exceeds a spacing between rail ends of the first track segment.

8. The combination according to claim 7, wherein the switch mechanism is adapted to move the first track segment between its first position and its second position by initially elevating and subsequently lowering the rail ends of the first track segment.

9. The combination according to claim 8, further comprising a support structure for supporting the first track segment, the support structure having abutments for supporting and locating at least some of the ties when the rail ends of the first track segment are in either of the first position and the second position.

10. The combination according to claim 7, further comprising a support structure for supporting the first track segment, the support structure having abutments for supporting and locating at least some of the ties when the rail ends of the first track segment are in either of the first position and the second position.

11. The combination according to claim 7, wherein the switch mechanism includes means for inclining at least one of the ties at least one of before and during movement of the first track segment from the first position to the second position to cause at least one part of the tracks in the switch zone portion to be cambered thereby presenting a smooth and gradual incline for imparting a smooth rolling motion to a vehicle traversing the at least one part of the tracks.

12. The combination according to claim 7, further comprising a support member supporting at least some of the ties, the switch mechanism further including a linkage having a substantially parallelogram-shaped configuration and comprising arms pivotally interconnecting the at least some of the ties to the support member.

13. The combination according to claim 7, wherein the switch zone portion of the first track segment further includes a third rail disposed adjacent the first rail and the second rail for supplying power to vehicles adapted to run on the rails.

14. The combination according to claim 7, wherein the switch mechanism is configured to move the switch zone portion between its first position and its second position such that the rail ends of the first track segment, in moving between the first position and the second position, travel directly above at least a portion of the second track segment.

* * * * *